United States Patent [19]

Kuo

[11] Patent Number: 4,509,689

[45] Date of Patent: Apr. 9, 1985

[54] CUTTING TORCH

[76] Inventor: Chuan-Ming Kuo, 2nd Fl. No. 10 La. 22 Tung Hwa N. Rd., Taipei, Taiwan

[21] Appl. No.: 506,426

[22] Filed: Jun. 21, 1983

Related U.S. Application Data

[63] Continuation-in-part of Ser. No. 432,169, Oct. 1, 1982, , which is a continuation-in-part of Ser. No. 395,164, Jul. 6, 1982.

[51] Int. Cl.[3] ..... B05B 7/12

[52] U.S. Cl. ..... 239/407; 239/416.3; 239/419.3; 239/430

[58] Field of Search ..... 239/416.3, 419.3, 424, 239/430, 407

[56] References Cited

U.S. PATENT DOCUMENTS

| | | | |
|---|---|---|---|
| 1,340,690 | 5/1920 | Coberly | 266/48 |
| 1,832,623 | 11/1931 | Fausek et al. | 239/430 |
| 1,955,846 | 4/1934 | Campbell | 239/430 |
| 2,198,342 | 4/1940 | Jacobsson et al. | 239/424.5 |
| 3,078,913 | 2/1963 | Anthens | 239/397.5 |
| 4,022,441 | 5/1977 | Turney | 239/424.5 X |
| 4,248,384 | 2/1981 | Zwicker | 239/419.3 |
| 4,413,809 | 11/1983 | Fischer | 266/48 |

*Primary Examiner*—Andres Kashnikow
*Assistant Examiner*—James R. Moon, Jr.

[57] ABSTRACT

An oxygen-fuel cutting torch having an easily manufactured preheat tube assembly assuring complete mixing of the oxygen and fuel, and minimizing the danger associated with flashback of the flame into the torch. The preheat tube assembly includes an outer tube, an inner tube, a mixer tube, and a nozzle fitting. The inner tube and mixer tube are joined together end to end by the nozzle fitting and are both positioned within the outer tube. A chamber is formed in the oxygen channel at the juncture of the nozzle fitting and the mixing tube for increasing the turbulence of the oxygen prior to mixing with the fuel and to attenuate the shock wave generated by flashbacks.

20 Claims, 5 Drawing Figures

CUTTING TORCH

RELATED APPLICATIONS

This application is a continuation in part of my U.S. patent application Ser. No. 432,169, filed Oct. 1, 1982, which in turn is a continuation of part of my U.S. patent application Ser. No. 395,164, filed July 6, 1982.

This invention relates to the field of oxygen-fuel cutting torches and in particular to a new design of preheat tube for mixing the oxygen and fuel for the preheat flame of the torch.

BACKGROUND OF THE PRIOR ART

A majority of the components of a hand held cutting torch have become relatively standardized in their function, structure and appearance. However, continuing development of the structure for mixing the oxygen and the fuel for the preheat flame of the torch has occurred in an effort to overcome long existent problems with hand held cutting torches. These problems include the susceptibility of the torch to potentially dangerous flashbacks or popping caused by the burning of the fuel-oxygen mixture within the torch itself. These flashbacks create high pressure shock waves within the torch which can rupture the wall of the torch or cause a chain reaction of flashbacks sending burning fuel and oxygen upstream in one or both of the fuel and oxygen supply lines.

The flashback problem is worsened when using so called low pressure fuels such as MAPP gas in a torch which is designed for higher pressure gases such as acetylene.

Other problems with prior art torches include incomplete or inconsistent mixing of the oxygen of the oxygen and fuel resulting in rough and unstable preheat flames.

Prior attempts to overcome these problems have included the use of relatively complex mixing structures employing intricate passageways and/or heat absorbing and shock wave dissipating spirals placed within the passageways.

None of the prior art techniques has been perfectly successful in preventing flashbacks, and while many have resulted in satisfactory mixing of the oxygen and fuel gas, all of the prior art structures have involved relatively intricate and expensive machining which has unnecessarily increased the cost of producing the cutting torches.

SUMMARY OF THE INVENTION

Accordingly, it is an object of the present invention to provide a torch which obviates the tendency to flash back and which minimizes the potential danger of such flashbacks if they do occur.

It is a further object of the present invention to provide a cutting torch which minimizes the susceptibility of the torch to flash back danger while at the same time assuring adequate mixing of the fuel and oxygen, without unnecessarily increasing the cost of producing the torch.

It is a specific object of the present invention to provide a cutting torch having a preheat tube which includes an improved mixing structure which is extremely simple to manufacture and which assures proper mixing of the fuel and oxygen and proper control of the fuel flow to minimize the occurrence of flashbacks and which immediately extinguishes the flashbacks that do occur in order to prevent any dangerous sustained burning or chain reaction flashbacks.

The above-mentioned objects of the invention are achieved by providing a cutting torch having a preheat tube in which the mixing structure within the preheat tube includes a chamber in the oxygen passageway upstream of the injection point at which the fuel is mixed with the oxygen. The chamber is extremely simple to machine during the manufacturing of the torch parts and, when properly positioned, causes sufficient turbulence in oxygen flow to assure complete and consistent mixing of the oxygen with the fuel, even at low fuel pressures.

Furthermore, if a flashback occurs, the chamber acts as a trap for the resultant shock wave, minimizing the propagation of the shock wave upstream of the chamber. To further enhance the functioning of the chamber a nozzle and spiral are disposed immediately upstream of the chamber.

The preheat tube preferably includes a removable assembly consisting of an inner tube and a mixer tube which are individually machined and then joined together end to end. The chamber is advantageously formed at the joint of the two tubes, thereby simplifying the machining of the chamber. For ease of manufacture the nozzle is preferably located in a nozzle fitting which threadedly engages both the inner tube and the mixer tube. The entire assembly is slidable within the preheat tube and is removably secured by threadably attaching the downstream end of the assembly to the cutting head of the torch. The upstream end of the assembly with wrenching flats to facilitate the assembly and disassembly of the preheat tube.

The actual mixing of the fuel with the oxygen is accomplished at a point immediately downstream of the chamber where a plurality of transverse passageways leading from the fuel carrying channel intersect the central passageway leading from the chamber. These transverse passageways are preferably disposed at an acute angle to the longitudinal axis of the mixer tube such that the transverse passageways are pointed downstream and inwardly toward the center of the mixer tube. This assures that the fuel carried by these passageways has a downstream velocity component which facilitates mixing and minimizes the propagation of flashbacks in the upstream direction.

BRIEF DESCRIPTION OF THE DRAWINGS

The present invention will now be described with reference to the accompanying drawings showing preferred embodiments of the cutting torch of the present invention. In the figures.

DETAILED DESCRIPTION OF THE INVENTION

Figure 1:
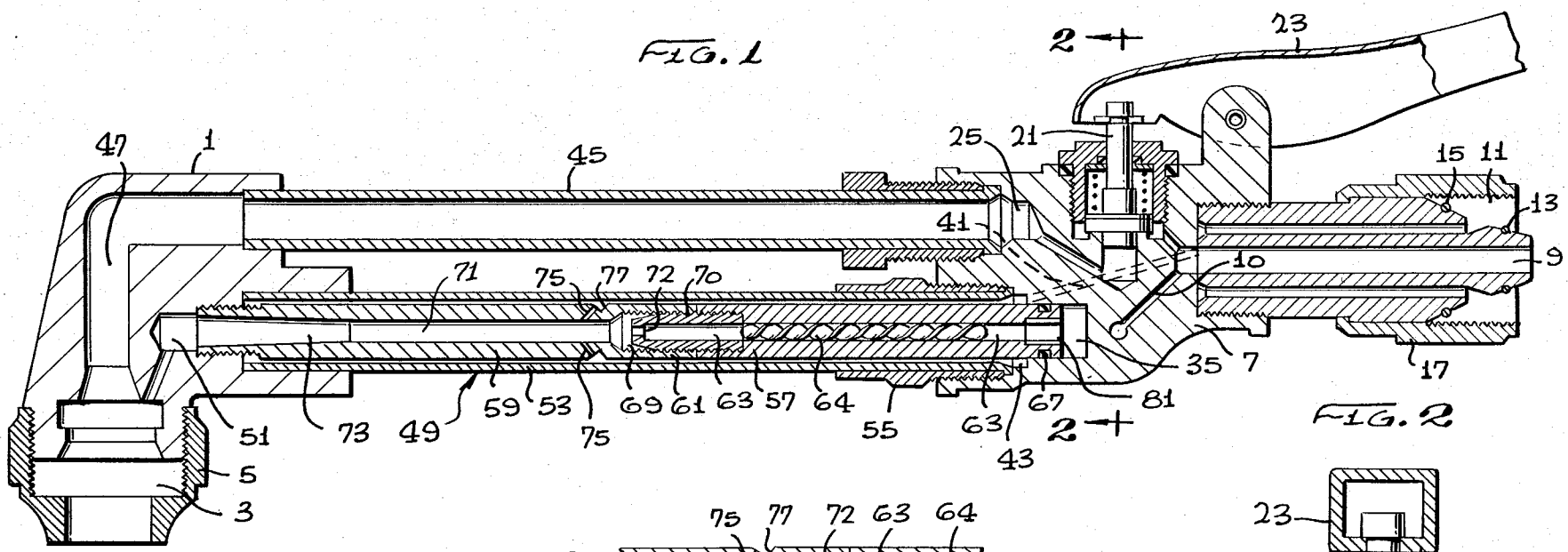
FIG. 1 is a cross sectional view of the cutting torch of the present invention.
Figure 2:
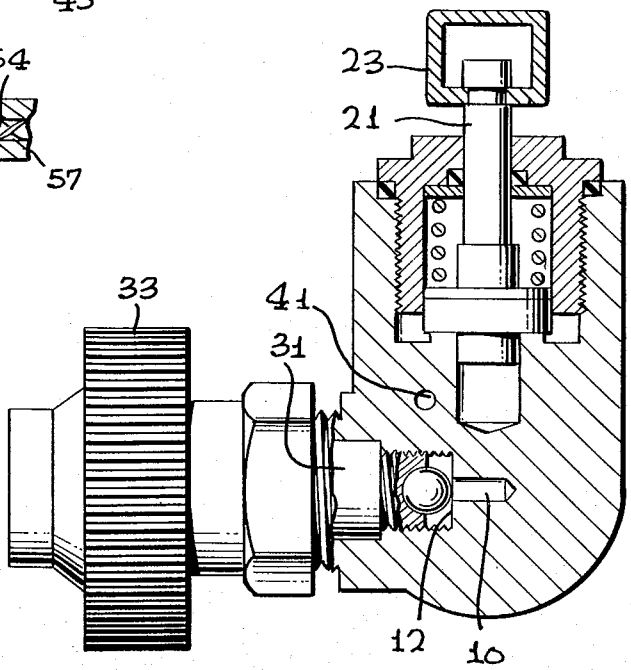
FIG. 2 is a cross sectional view taken along line 11—11 of FIG. 1.

As shown in FIGS. 1 and 2, the cutting torch of the present invention includes cutting head 1 having opening 3 for receiving a cutting tip (not shown). The locking nut 5 secures the cutting tip in place on the cutting head 1.

Valve body 7 includes oxygen inlet 9 and fuel inlet 11. The particular valve body 7 shown in FIG. 1 is intended to be attached to a welding torch having concentric oxygen and fuel outlets designed to mate with oxygen inlet 9 and fuel inlet 11. Inner O-ring 13 acts as a seal for the oxygen passageway and prevents mixing of the oxygen and the fuel. Outer O-ring 13 seals the fuel passageway from the atmosphere. The cutting torch may be removably secured to the welding torch with threaded nut 17.

Valve body 7 includes a cutting oxygen valve 21 having an operating handle 23. When the operating handle 23 is depressed, the valve 21 is opened allowing oxygen from inlet passageway 9 to flow through the valve body and out through cutting oxygen outlet 25.

As best shown in FIG. 2, the valve body 7 also includes a preheat oxygen control valve 31 including a knob 33 which can be turned to control the flow of oxygen from the inlet passageway 9 to the preheat oxygen outlet 35 via passageway 10, valve seat 12 and a small passageway (not shown) from the valve seat area to outlet 35. Fuel inlet 11 communicates through an internal bore 41 (shown in dotted lines in FIG. 1) to preheat fuel outlet 43.

Cutting oxygen tube 45 couples cutting oxygen outlet 25 of the valve body 7 to the cutting oxygen passageway 47 in the cutting head 1.

The preheat tube assembly 49 couples the preheat oxygen outlet 35 and the preheat fuel outlet 43 of the valve body 7 to the preheat mixture passageway 51 of the torch head 1.

The preheat tube assembly 49 includes outer tube 53 which is removably secured at its first end to the valve body 7 by means of threaded nut 55. The second end of the outer tube 53 is secured to the cutting head 1 by soldering, brazing, or threaded engagement. Inner tube 57 is slidably received within the outer tube 53 and includes a first end which extends beyond the first end of the outer tube. The second end of the inner tube 57 is threadably received within the first end of a mixer tube 59. Naturally, any other convenient means may be used for attaching the second end of the inner tube to the first end of the mixer tube.

The outer surface of the inner tube 57 and the mixer tube 59 and the inner surface of the outer tube 53 define an annular passageway 61. This passageway is a fuel channel which communicates with preheat fuel outlet 43 of valve body 7. The inner bore 63 of inner tube 57 defines an oxygen passageway which communicates with preheat oxygen output 35 of valve body 7. O-ring 67 sealingly engages the first end of inner tube 57 and valve body 7 to prevent leakage between the fuel passageway and the oxygen passageway.

Figure 3:
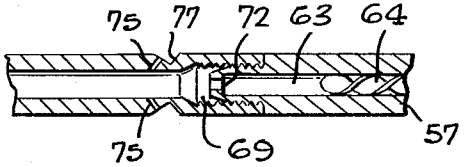
FIG. 3 is a cross sectional view of an alternate construction of the nozzle and chamber regions of the inner and mixer tubes.

The inner tube 57 and the mixer tube 59 are preferably joined by a threaded fitting 70 having an oxygen passageway therein which communicates with the oxygen passageway 63 in inner tube 57. Alternatively, fitting 70 can be manufactured integral with inner tube 57 as shown in FIG. 3.

A chamber 69 is formed at the juncture of inner tube 57 and mixer tube 59 immediately downstream of fitting 70. The chamber is preferably at least twice the diameter of the oxygen passageway 63, and its length is approximately equal to its diameter. As shown in FIG. 1, the chamber 69 preferably includes an inwardly sloping downstream end forming a frusto-conical exit to the chamber. The fitting 70 also preferably has a similar inwardly sloping downstream end forming a frusto-conical nose where it meets chamber 69.

The fitting 70 is provided with a nozzle 72 at its juncture with chamber 69, the nozzle 72 having a smaller diameter than oxygen passageway 63 in inner tube 57. Preferably, the length of the nozzle 72 is relatively short compared to the length of fitting 70 and the majority of the length of fitting 70 has an oxygen passageway 63 preferably of the same diameter as oxygen passageway 63 in inner tube 57.

Figure 4B:
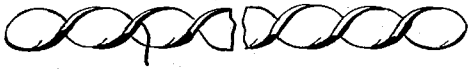
FIGS. 4(*a*) and 4(*b*) are enlarged end and side views of a spiral.
Figure 4A:
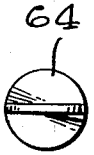

Oxygen passageway 63 has a spiral 64, preferably made of a metal having good heat conducting properties, such as copper, is disposed therein upstream of nozzle 72. The spiral is shown in detail in FIGS. 4(*a*) and 4(*b*). The spiral is preferably about 2.7 mm in diameter, 62 mm in length and 0.85 mm in thickness.

The chamber 69 communicates with mixing channel 71 formed by the central bore of mixer tube 59. The mixing channel 71, in turn, communicates with the preheat mixture passageway 51 in the cutting head 1. The downstream end of the mixing channel 71 may preferably include a flared portion 73 which increases in diameter in the downstream direction. This flaring section creates a low pressure turbulent area in the mixing channel which enhances the mixing of the fuel and the oxygen.

The fuel and oxygen are initially mixed near the first end of the mixer tube 59 downstream of the chamber 69 and the nozzle 72 on fitting 70. A plurality of symmetrically disposed passageways 75 are formed transverse to the axis of the mixer tube 59 and communicate with both the fuel channel 61 and the mixing channel 71. The passageways 75 are preferably disposed at an acute angle with respect to the longitudinal axis of the mixer tube and slant downstream and inward toward the center of the mixer tube. To aid in the drilling of these holes and to minimize pressure losses in the fuel flow, an annular recess 77 may be formed in the outer wall of the mixer tube and positioned such that the passageways 75 impinge this annular recess. The downstream wall of this recess may advantageously be formed at a right angle to the axis of the passageways 75 to facilitate drilling of the passageways.

In the normal functioning of the torch, the preheat oxygen flow rate is adjusted using the preheat oxygen control valve 31 and the fuel flow rate is established by an external fuel control valve (not shown) upstream of the fuel inlet 11. The oxygen flows from the control valve 31 to the preheat fuel outlet 35 and through oxygen channel 63 and into chamber 69. In flowing through the nozzle 72 and into the chamber 69, the oxygen flow becomes significantly more turbulent in order to facilitate mixing of the oxygen with the fuel. The fuel flows through the inlet 11, through the passageway 41 in the valve body 7 and through the fuel outlet 43 into the fuel channel 61 between the outer tube 53, the inner tube 57, and the mixer tube 59. The fuel then flows into the recess 77 and through the plurality of passageways 75 into the mixing channel 71 where it is mixed with the turbulent oxygen flowing from the chamber 69 and nozzle 72. Naturally, the fuel and oxygen continue to mix throughout the length of the mixing channel 71, including the flared section 73 and are completely and uniformly mixed prior to entering the preheat mixture passageway 51 in the cutting head 1.

Normally, the flow rates of the preheat oxygen and the preheat fuel are adjusted so that the mixture ratio of the oxygen and fuel is proper to give a clean burning, high temperature flame at the outlet of the cutting tip and to assure that the flame propagation rate of the mixture is less than or equal to the velocity of the mixture exiting the cutting top. This assures that the mixture will burn only outside of the cutting torch.

If the flow rates are set too low for the size of the cutting tip being used, the flame front will propagate into the torch tip and can progress upstream along the mixing channel 71. This phenomenon is called "flashback" and results in a small explosion within the torch when the flame propagation rate drastically increases as the flame front moves within the torch where the pressures of the oxygen and fuel in the preheat mixture are greater. The explosion sets off a shock wave which could travel throughout the fuel and oxygen passageways causing damage to the upstream components of the system. Additionally, the localized high pressure characterizing the moving shock wave can carry small amounts oxygen along the fuel line or small amounts of fuel along the oxygen line causing additional flashbacks upstream of the cutting torch with potentially disastrous results. Since many of the fuels used for cutting are unstable at high pressures, the instantaneous high pressures accompanying the shock wave caused by the flashbacks can result in large scale explosions of the fuel tanks.

The above-described preheat tube assembly of the present invention minimizes the flashback possibilities in a number of ways.

First, as mentioned above, the mixing channel 71 is so designed as to assure complete and consistent mixing of the fuel and oxygen so that the ratio of fuel to oxygen and the resultant flame propagation rate of the mixture exiting the cutting tip is stable.

Second, the geometry of the passageways in the vicinity of the point of mixing are so designed as to immediately extinguish any flashbacks which reach this part of the torch and to damp the shock waves formed by the flashback. The tapering exit of the chamber 69 forms a flaring entrance to the chamber for any shock waves traveling upstream along the mixing channel 71. This tends to spread out the shockwave entering the chamber 69. When the shock wave contacts the upstream end of the chamber, it is reflected and thereby attenuated, minimizing the strength of the shock wave passed into the nozzle 72.

Should the shock wave propagate past nozzle 72, then spiral 64 will further absorb energy from the shock wave and thereby diminish its further propagation.

This structure is very effective in mixing the oxygen and the fuel and also in preventing flashbacks and minimizing the danger associated with flashbacks, while at the same time being easy to construct. Preferably, the downstream end and sidewalls of the chamber are formed as part of the upstream end of the mixer tube 59. The upstream end of the chamber is formed as part of the downstream end of the inner tube 57. The tubes are preferably joined together by threaded engagement with fitting 70, which threaded joints preferably are soldered or brased together to form the completely enclosed chamber 69 and nozzle 72 in an essentially integral assembly without the need for any intricate machining. All of the passageways within the preheat tube assembly can be machined by simple conventional techniques and the seals can be formed by using O-rings or tapered threads.

To faciliate cleaning and exchange of the internal components of the preheated tube (if necessary) for use with alternate fuels or different flow rates, the upstream end of the inner tube 57 may include wrenching flats 81 to allow the insertion of an Allen wrench or the like for removal of the inner tube 57 and the mixer tube 59.

Naturally, the shapes of the various elements of the preheat assembly may be varied for specific purposes and the various seals may be formed using other conventional means. Additionally, the principals of the present invention can also be used in a machine torch in which the preheat oxygen and preheat fuel control valve are positioned in a location remote from the preheat tube and connected to the preheat tube by flexible tubing or the like.

Accordingly, while a specific embodiment of the present invention has been disclosed, it is to be understood that the disclosed embodiment has been made by way of example and that numerous changes in the details of constructions are foreseen. Accordingly, the scope of the present invention is to be limited only by the appended claims.

What is claimed is:

1. A cutting torch comprising:

a cutting head for receiving a removable cutting tip;

a valve body having an oxygen inlet, a fuel inlet, a cutting oxygen outlet, a preheat oxygen outlet, and a preheat fuel outlet communicating with said fuel inlet;

a cutting oxygen control valve for controlling the flow of oxygen from said oxygen inlet to said cutting oxygen outlet;

a preheat oxygen control valve for controlling the flow of oxygen from said oxygen inlet to said preheat oxygen outlet;

a cutting oxygen tube connecting said cutting oxygen outlet to said cutting head; and a preheat tube connecting said preheat oxygen outlet and said preheat fuel outlet with said cutting head, said preheat tube including:

an outer tube having a first end connected to said valve body and a second end connected to said cutting head;

an inner tube the majority of which is within said outer tube and having a first end extending beyond the first end of said outer tube and a second end within said outer tube;

a nozzle fitting having a first end sealing connected to said second end of said inner tube;

a mixer tube having a first end sealingly connected to a second end of said nozzle fitting, said mixer tube having a second end sealingly connected to said cutting head, the outer surfaces of said inner tube and said mixer tube and the inner surface of said outer tube defining a fuel channel communicating with said preheat fuel outlet; and sealing means adjacent the first end of said inner tube for isolating said fuel channel from said preheat oxygen outlet, said inner tube and said nozzle fitting including a central bore defining an oxygen channel communicating with said preheat oxygen outlet, said nozzle fitting having a nozzle of smaller diameter than to said oxygen bore, said nozzle being disposed at the second end of said fitting, said central core having a heat absorbing metallic spiral disposed therein upstream of said nozzle.

said second end of said nozzle fitting and said first end of said mixer tube defining a chamber of larger diameter than said oxygen channel, said mixer tube including a central bore defining a mixing channel communicating with said chamber and said cutting head, said mixer tube also including a plurality of transverse passageways communicating with said fuel channel and said mixing channel at a point adjacent to but spaced from said chamber.

2. The cutting torch as claimed in claim 1, wherein the diameter of said mixing channel at said first end of said mixer tube is smaller than the diameter of said chamber.

3. The cutting torch as claimed in claim 1, wherein the diameter of said mixing channel gradually increases from a point downstream of said transverse passageways to said second end of said mixer tube.

4. The cutting torch as claimed in claim 1, wherein said plurality of pasageways are evenly distributed around the circumference of said mixer tube at a point immediately downstream of the first end thereof.

5. The cutting torch as claimed in claim 1, wherein each of said plurality of passageways is inclined at an acute angle to the axis of said mixer tube and pointed downstream toward the center of said mixer tube.

6. The cutting torch as claimed in claim 5, wherein said mixer tube includes an annular recess around the outer periphery thereof and each of said passageways intersect said annular recess.

7. The cutting torch as claimed in claim 1, wherein said mixer tube is removably connected to said cutting head.

8. The cutting torch a claimed in claim 7, wherein said mixer tube is threadably received in said cutting head.

9. The cutting torch as claimed in claim 8, wherein said first end of said inner tube includes wrenching flats on the inner surface thereof to facilitate insertion and removal of said inner tube and said mixer tube.

10. The cutting torch as claimed in claim 1, wherein said second end of said nozzle fitting is thereadably received in said first end of said mixer tube and the first end of said nozzle fitting is threadably received in said second end of said inner tube.

11. The cutting torch as claimed in claim 1, wherein said first end of said preheat tube is removably received in said valve body.

12. The cutting torch as claimed in claim 1, wherein the diameter of said oxygen channel is substantially constant from the first end of said inner tube to said nozzle.

13. The cutting torch as claimed in claim 1, wherein the diameter of said chamber is at least twice the diameter of said oxygen channel at the second end of said inner tube.

14. The cutting torch as claimed in claim 13, wherein the length of said chamber is approximately equal to its diameter.

15. The cutting torch as claimed in claim 1, wherein the downstream end of said chamber narrows in the downstream direction.

16. A cutting torch comprising:

a cutting head for receiving a removable cutting tip;

a valve body having an oxygen inlet, a fuel inlet, a cutting oxygen outlet, a preheat oxygen outlet, and a preheat fuel outlet communicating with said fuel inlet;

a cutting oxygen control valve for controlling the flow of oxygen from said oxygen inlet to said cutting oxygen outlet;

a preheat oxygen control valve for controlling the flow of oxygen from said oxygen inlet to said preheat oxygen outlet;

a cutting oxygen tube connecting said cutting oxygen outlet to said cutting head; and a preheat tube connecting said preheat oxygen outlet and said preheat fuel outlet with said cutting head, said preheat tube including:

an outer tube having a first end connected to said valve body and a second end connected to said cutting head;

an inner tube the majority of which is within said outer tube and having a first end extending beyond the first end of said outer tube and a second end within said outer tube;

a mixer tube having a first end sealingly connected to said second end of said inner tube, said mixer tube having a second end sealingly connected to said cutting head, the outer surfaces of said inner tube and said mixer tube and the inner surface of said outer tube defining a fuel channel communicating with said preheat fuel outlet; and sealing means adjacent the first end of said inner tube for isolating said fuel channel from said preheat oxygen outlet, said inner tube including a central bore defining an oxygen channel communicating with said preheat oxygen outlet and a nozzle at its second end, the inside diameter of said nozzle being less than the diameter of said central bore, said central bore having a heat absorbing spiral disposed therein upstream of said nozzle, said second end of said inner tube and said first end of said mixer tube defining a chamber of larger diameter than said oxygen channel, said mixer tube including a central bore defining a mixing channel communicating with said chamber and said cutting head, said mixer tube also including a plurality of transverse passageways communicating with said fuel channel and said mixing channel at a point adjacent to but spaced from said chamber.

17. The cutting torch as claimed in claim 16, wherein the diameter of said mixing channel at said first end of said mixer tube is smaller than the diameter of said chamber.

18. The cutting torch as claimed in claim 16, wherein the diameter of said mixing channel gradually increases from a point downstream of said transverse passageways to said second end of said mixer tube.

19. The cutting torch as claimed in claim 16, wherein each of said plurality of passageways is inclined at an acute angle to the axis of said mixer tube and pointed downstream toward the center of said mixer tube.

20. The cutting torch as claimed in claim 19, wherein said mixer tube includes an annular recess around the outer periphery thereof and each of said passageways intersect said annular recess.

* * * * *